United States Patent [19]

Welsh et al.

[11] 4,248,362

[45] Feb. 3, 1981

[54] DISPENSER CLOSURE

[76] Inventors: William C. Welsh; Peter G. Kailis, both of 342 Scarborough Beach Rd., Osborne Park W.A., Australia, 6017

[21] Appl. No.: 79,464

[22] Filed: Sep. 27, 1979

[51] Int. Cl.[3] ..... B65D 47/20

[52] U.S. Cl. ..... 222/505; 222/511

[58] Field of Search ..... 222/505, 511, 512, 517, 222/528; 251/342

[56] References Cited

U.S. PATENT DOCUMENTS

| | | | |
|---|---|---|---|
| 3,400,866 | 9/1968 | Faitori | 222/511 |
| 3,443,728 | 5/1969 | Scholle | 222/511 |
| 3,972,452 | 8/1976 | Welsh | 222/505X |
| 4,169,548 | 10/1979 | Bond | 222/505 |

*Primary Examiner*—Charles A. Marmor

*Attorney, Agent, or Firm*—Harness, Dickey & Pierce

[57] ABSTRACT

A dispenser closure comprising a tubular spout to be connected at one end to a fluid container and a cap fitted to the other end of the spout, said cap being provided with a transverse wall of elastomeric material extending across the other end of the spout and being substantially wedge shaped in cross section with the wedge projecting inwardly into the other end of the tubular spout, an inwardly directed peripheral flange mounted on said transverse wall to sealingly engage with the inner surface of the tubular spout, a discharge outlet provided in the spout or in the cap outwardly of the region of sealing engagement between said peripheral flange and the inner surface of the tubular spout, the outer face of the transverse wall being provided with an outwardly directed protrusion to be manipulated to distort the transverse wall and the portion of the peripheral flange adjacent the discharge outlet to cause fluid flow from the container through the discharge outlet.

10 Claims, 4 Drawing Figures

DISPENSER CLOSURE

BACKGROUND OF INVENTION

A dispenser closure widely used in Australia and other countries is described in Australian Pat. No. 446218. Whilst generally satisfactory in use it has been known to leak particularly when a container to which it is fitted is subjected to sudden shocks or a number of containers are stacked one above the other. This particular dispenser closure suffers from the inherent disadvantage that the effectiveness of the seal is dependent on the diaphragmatic transverse wall closure making sealing contact with a peripheral edge of the discharge spout which sealing contact can be broken by increasing pressure within the container.

A dispenser closure which is substantially free of the above mentioned disadvantages is described in Australian Pat. No. 474900. It has been found that in use such a dispenser is hard to operate particularly when the container has been stored in a refrigerator and the rate of discharge is not satisfactory.

Another problem of the dispenser closure of the type described in Australian Pat. No. 474900 is that when the closure is placed in what is known as the dust cap position the internal sealing flange may take a set which interferes with the sealing action after the container has been filled and the closure pushed into the full sealing position.

OBJECT OF THE INVENTION

The object of the invention is to provide a dispenser closure which substantially retains the advantages of the closure described in Australian Pat. No. 474900 and is substantially free of the above disadvantages.

DEFINITION OF THE INVENTION

In one form the invention resides in a dispenser closure comprising a tubular spout to be connected at one end to a fluid container and a cap fitted to the other end of the spout, said cap being provided with a transverse wall of elastomeric material extending across the other end of the spout and being substantially wedge shaped in cross section with the wedge projecting inwardly into the other end of the tubular spout, an inwardly directed peripheral flange mounted on said transverse wall to sealingly engage with the inner surface of the tubular spout, a discharge outlet provided in the spout or in the cap outwardly of the region of sealing engagement between said peripheral flange and the inner surface of the tubular spout, the outer face of the transverse wall being provided with an outwardly directed protrusion to be manipulated to distort the transverse wall and the portion of the peripheral flange adjacent the discharge outlet to cause fluid flow from the container through the discharge outlet.

It has been found that the construction defined above has the same dust cap sealing problem as the closure described in Australian Pat. No. 474900 and that in both cases the problem can be overcome by providing a very slight taper on the external face of the sealing flange and a corresponding taper on the internal flange of the tubular spout to which the closure is fitted.

Thus in another form the invention resides in a dispenser closure assembly of the type defined above or of the type described in Australian Pat. No. 474900 wherein the external face of the sealing or inwardly directed flange is provided with a slight taper and the internal surface of the tubular spout on which the closure is fitted is provided with a corresponding taper.

In practice a taper of the order of 3° has been found to be adequate.

DESCRIPTION OF THE INVENTION

The various features of the invention will be better understood by reference to the following description of the specific embodiments shown in the accompanying drawings wherein.

Figure 1:
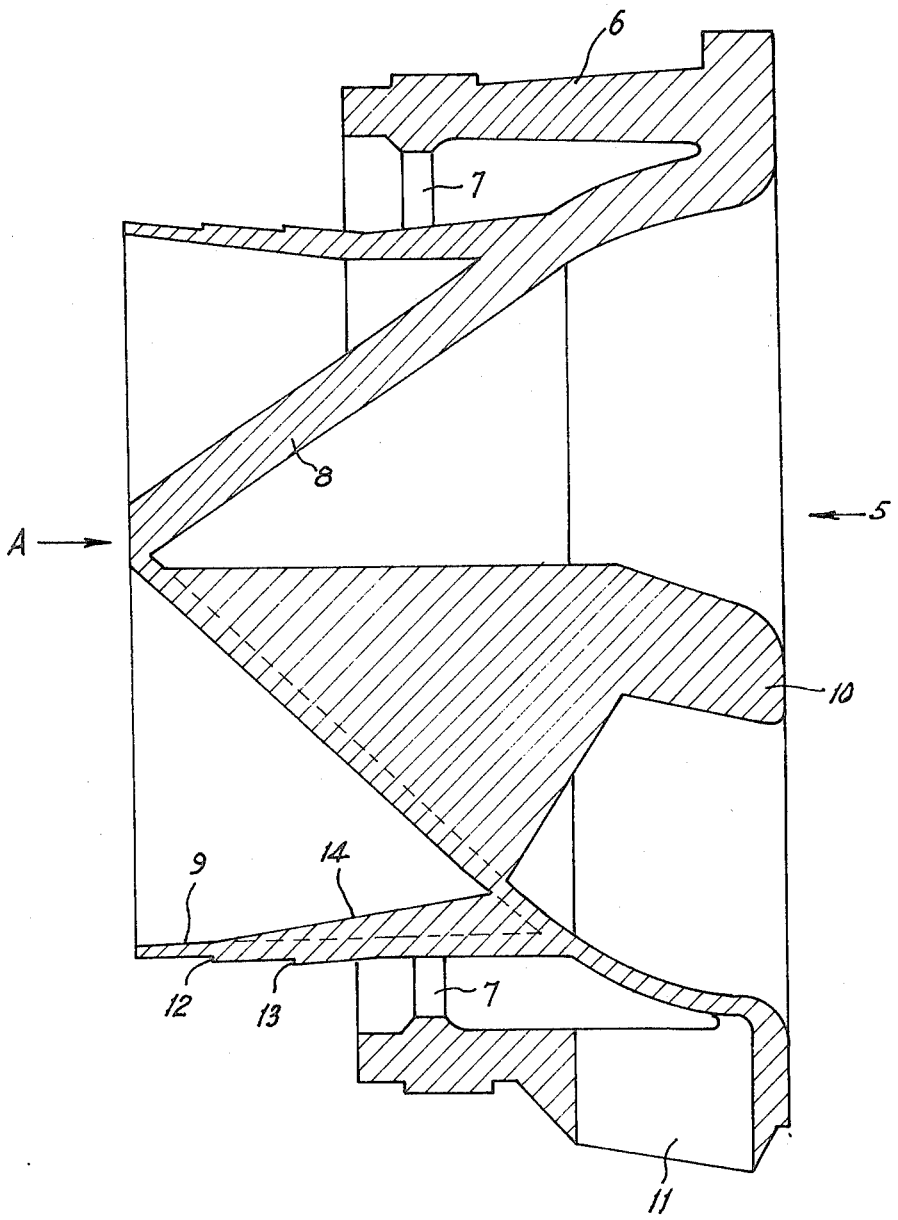
FIG. 1 is a sectional elevation of the cap of one embodiment.

The cap shown in FIG. 1 of the accompanying drawings is designed to be used on conjunction with the tubular spout 111 shown in FIG. 5 of Australian Pat. No. 474900 and no further description thereof would appear to be necessary. The cap 5 is substantially circular in front elevation and is provided with a skirt 6 to engage the outer wall of the tubular spigot. The inner periphery of the skirt is provided with an inwardly directed flange 7 to engage a groove formed on the outside of the spout adjacent the outer end thereof. The leading inner edge of the flange 7 and the outer edge of the spout are chamfered to facilitate the engagement of the flange 7 in the groove.

A transverse wall 8 which is wedge shaped in cross section projects into the outer end of the spigot when the cap is in position. The outer periphery of an inwardly directed peripheral flange 9 which sealingly engages the inner surface of the spout is formed integral with the outer periphery of the wall 8. The outer face of the wall is provided with an outwardly projecting protrusion or operating knob 10 whilst a discharge outlet 11 is formed in the lower portion of the skirt. The discharge outlet connected to the space between the skirt 6 and the flange 9 and is located outwardly, i.e. towards the outer end of the spigot, of the region of sealing engagement between the flange 9 and the inner surface of the spigot. Preferably the sealing face of the flange 9 is provided with stepped portions 12 and 13 to increase the sealing action. The stepped portion may be replaced by ribs which are semi-circular in cross section and function in a manner similar to an O-ring to increase the sealing action. A gusset 14 is provided between the inner face of the wall 8 and the flange 9 in the vicinity of the discharge outlet.

The apex A of the wedge shaped wall provides a firm hinge so that when the wall is distorted through the action of the upwardly directed force applied to the knob 10 the flange 9 in the vicinity of the outlet is lifted clear of the inner surface of the spout to allow liquid to pass therebetween and then through the outlet.

In order to prevent dripping, after the closure has been operated, through liquid being drawn into in the space between the skirt 6 and the flange 9 adjacent the junction thereof by capillarly action a wall (not shown) to block off the space may be provided on either side of the outlet. Alternatively the space may be completely filled except in the region of the outlet as will be explained hereafter in connection with the second embodiment.

If desired the outlet may be provided in the spout rather than in the skirt of the cap so that when the flange is lifted clear of the inner surface of the spout the outlet is exposed and liquid flows therethrough. The ends of the wedge portion of the wall 8 may be connected to the adjacent portion of the flange 9 but this does tend to increase the force required to operate the closure. The connection may also interfere with the sealing action of the flange by increasing the rigidity thereof. It is this preferable that there be no connection between the wall 8 and the flange 9 other than at the junction thereof.

Figure 2:
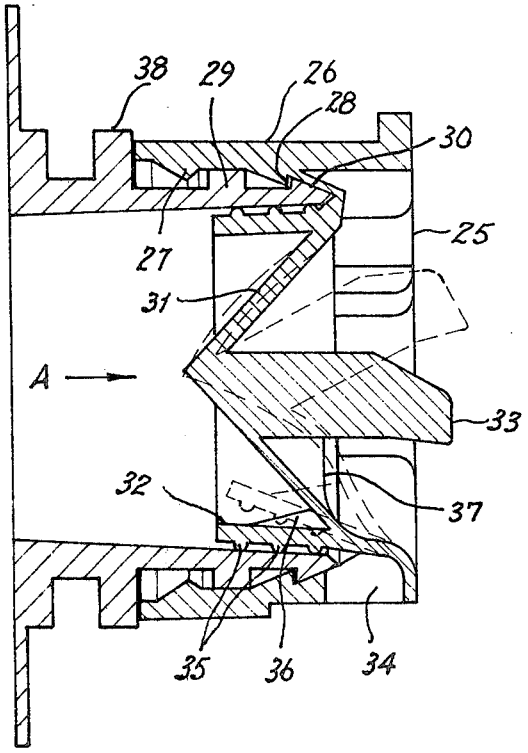
FIG. 2 is a sectional elevation of a second embodiment showing the cap fitted to the spout in the closed position with the open position being shown in broken lines.
Figure 3:
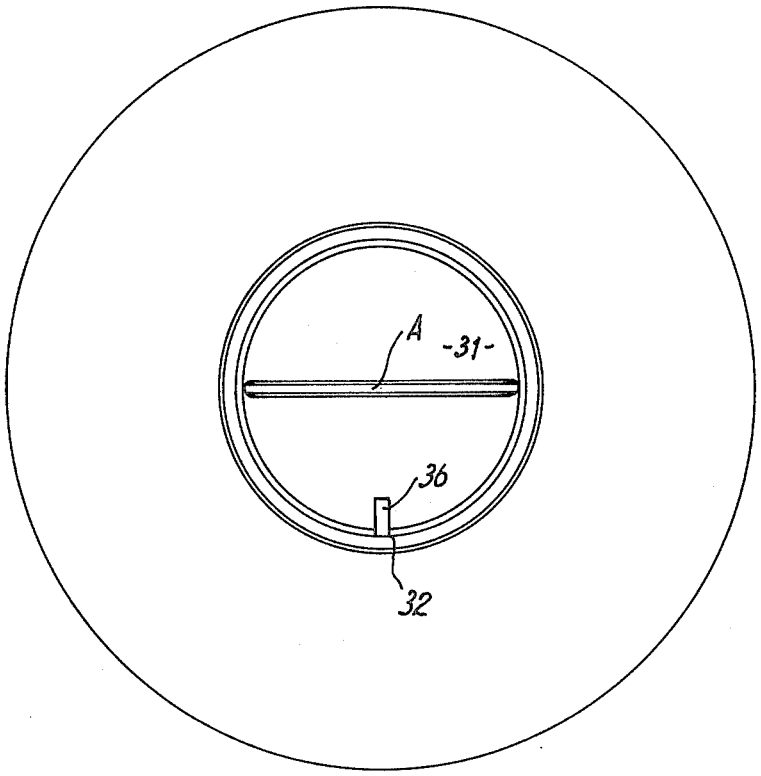
FIG. 3 is an internal end elevation of the second embodiment.
Figure 4:
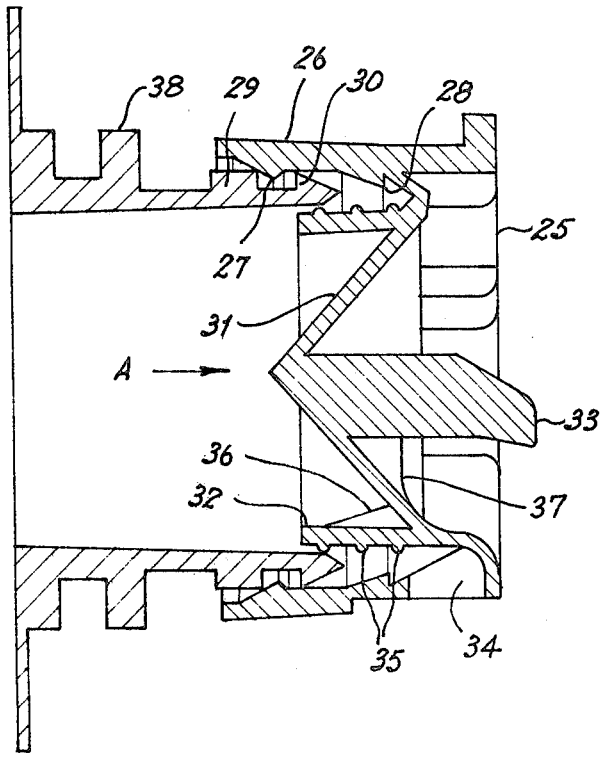
FIG. 4 is a sectional elevation of the second embodiment showing the cap in the dust cap position.

In the embodiment shown in FIGS. 2, 3 and 4 of the drawings the tubular spout 111 is similar to that shown in FIG. 5 of Australian Pat. No. 474900 and again no detailed description thereof would appear to be necessary. The cap 25 is provided with a skirt 26 the inner face of which is provided with a set of inwardly directed flanges 27, 28 to engage a corresponding set of ridges 29, 30 formed on the outside of the spout towards the outer end thereof. The leading edge of the flanges 27 and 28 and the leading outer edge of the ridge 30 are chamfered to facilitate the engagement of the flanges over the ridges. The cap 25 is substantially circular in front elevation. A transverse wall 31 which is wedge shaped in cross section projects into the outer end of the spigot when the cap is in position with an inwardly directed peripheral flange 32 in sealing engagement with the inner surface of the spigot. The outer face of the wall is provided with an outwardly projecting protrusion or operating knob 33 whilst a discharge outlet 34 is formed in the lower portion of the skirt. The discharge outlet connects to the space between the skirt 26 and the flange 32 and is located outwardly, i.e. towards the outer end of the spigot, of the region of sealing engagement between the flange 32 and the inner surface of the spigot. Preferably the sealing face of the flange 32 is provided with spaced ribs 35 which are substantially semi circular in cross section to increase the sealing action. A gusset 36 is provided between the inner face of the wall 31 and the flange 32 in the vicinity of the discharge outlet.

The apex A of the wedge shaped wall provides a firm hinge so that when the wall is distorted through the action of an upwardly directed force applied to the knob 33 the flange 32 in the vicinity of the outlet is lifted clear of the inner surface of the spigot as shown in broken lines in FIG. 2 to allow liquid to pass therebetween and then through the outlet.

If desired the outlet may be provided in the spigot rather than in the skirt of the cap.

The junction of the periphery of the transverse wall 31 and the skirt 26 is so shaped that it mates with the outer end of the spigot thereby eliminating any cavity therebetween and avoiding the possibility of any liquid being retained in the cap after a dispensing operation. A series of gussets 37 are provided on the outside of the periphery of the transverse wall between the transverse wall and the portion of the flange 32 opposite the discharge outlet 11.

In accordance with a feature of the present invention the inner face of the spout 111 and the outer face of the sealing flange 32 are tapered slightly to approximately 3° to the horizontal the taper being towards the outer end of the spout, i.e. the diameter of the outer end of the spout 111 is slightly greater than the diameter of the inner end. The degree of taper has been exaggerated in the drawings for the sake of clarity.

When the cap is fitted in what is known as the dust cap position as shown in FIG. 4 the inner rib 27 on the inside of the face of the skirt 26 is pushed over the outer ridge 30 on the spout and up against the ridge 29. In this position the inner end of the flange 32 make a friction fit with the inner surface of the spout to prevent dust entering in the container. When the container reaches the filling position it is a simple matter for an operator to pull the cap outwardly so that the flange 27 bears against the inner edge of ridge 30 and rotate the cap to bring the discharge outlet to the desired position in relation to the spout. The cap is then removed by the filling machine and when the container is filled the cap is replaced and the flanges 27, 28 pushed over the flanges 30 and 29 successively until inner end of the skirt 26 bears against a flange 38. This is the fully closed position and the sealing flange 32 is in full sealing engagement with the inner face of the spout. The slight taper assists the sealing action.

Because in the dust cap position the sealing flange 32 only bears slightly against the inner surface of the spout it does not assume a permanent set which interferes with the sealing action when the cap is pushed to the full sealing position.

The ends of the wall 31 may be fixed to the flange 32 but are preferably separate therefrom as is best seen in FIG. 3 of the drawings to ensure that the flange will seal properly on the inner surface of the spigot when the cap is in the closed position.

What is claimed is:

1. A dispenser closure comprising a tubular spout to be connected at one end to a fluid container and a cap fitted to the other end of the spout, said cap being provided with a transverse wall of elastomeric material extending across the other end of the spout and being substantially wedge shaped in cross section with the wedge projecting inwardly into the other end of the tubular spout, an inwardly directed peripheral flange mounted on said transverse wall to sealingly engage with the inner surface of the tubular spout, a discharge outlet formed outwardly of the region of sealing engagement between said peripheral flange and the inner surface of the tubular spout, the outer face of the transverse wall being provided with an outwardly directed protrusion to be manipulated to distort the transverse wall and the portion of the peripheral flange adjacent the discharge outlet to cause fluid flow from the container through the discharge outlet.

2. A dispenser closure as claimed in claim 1 wherein the end of the wedge shaped transverse wall is connected to the peripheral flange.

3. A dispenser closure as claimed in claim 1 or 2 wherein the sealing face of the flange is provided with stepped portions to increase the sealing action.

4. A dispenser closure as claimed in claim 1 or 2 wherein the sealing face of the flange is provided with a plurality of spaced ribs which are semi circular in cross section.

5. A dispenser closure as claimed in claim 4 having a gusset between the inner face of the wall and the flange adjacent the portion of the discharge outlet.

6. A dispenser closure as claimed in claim 5 wherein the cap is provided with a skirt to engage the outer face of the spout and a wall is provided on either side of the discharge outlet to seal off the space between the skirt and the flange adjacent the junction thereof.

7. A dispenser closure as claimed in claim 6 wherein the cap is provided with a skirt to engage the outer face of the spout and the outer end of the spout is so designed to substantially fill the space between the skirt and the flange adjacent the junction thereof.

8. A dispenser closure as claimed in claim 7 wherein the external face of the sealing or inwardly directed flange is provided with a slight taper and the internal surface of the tubular spout is provided with a corresponding taper.

9. A dispenser closure as claimed in claim 8 wherein the taper is 3°.

10. A dispenser closure comprising a tubular spout to be connected at one end to a fluid container and a cap having a skirt fitted to the other end of the spout, said cap being provided with a transverse wall of elastomeric material extending across the other end of the spout and being substantially wedge shaped in cross section with the wedge projecting inwardly into the other end of the tubular spout, an inwardly directed peripheral flange mounted on said transverse wall to sealingly engage with the inner surface of the tubular spout, a discharge outlet formed outwardly of the region of sealing engagement between said peripheral flange and the inner surface of the tubular spout, an outwardly directed protrusion on the outer face of the transverse wall which can be manipulated to distort the transverse wall and the portion of the peripheral flange adjacent the discharge outlet to cause fluid flow from the container through the discharge outlet and the skirt is provided with inwardly directed flanges adapted to engage with corresponding outwardly directed ridges on the outer face of the spout, the external face of the flange being provided with a slight taper and the internal surface being provided with a corresponding taper whereby said cap can be placed on the spout in an initial dust cap position with the inner portion of the flange in a dust sealing position with the inner surface of the spout.

* * * * *